US010357132B1

(12) United States Patent
Martin

(10) Patent No.: US 10,357,132 B1
(45) Date of Patent: Jul. 23, 2019

(54) SLOPED SOAP HOLDER

(71) Applicant: James Martin, Hitchcock, TX (US)

(72) Inventor: James Martin, Hitchcock, TX (US)

( * ) Notice: Subject to any disclaimer, the term of this patent is extended or adjusted under 35 U.S.C. 154(b) by 0 days.

(21) Appl. No.: 15/682,035

(22) Filed: Aug. 21, 2017

(51) Int. Cl.

| | |
|---|---|
| ***A47K 5/00*** | (2006.01) |
| ***A47K 1/09*** | (2006.01) |
| ***A47K 5/03*** | (2006.01) |
| ***A47K 5/08*** | (2006.01) |
| *A47F 7/00* | (2006.01) |

(52) U.S. Cl.
CPC ..... *A47K 1/09* (2013.01); *A47K 5/03* (2013.01); *A47K 5/08* (2013.01); *A47F 7/00* (2013.01)

(58) Field of Classification Search
CPC ... A47K 1/09; A47K 5/03; A47K 5/04; A47K 5/08; A47F 7/00
USPC ..... 206/77.1
See application file for complete search history.

(56) References Cited

U.S. PATENT DOCUMENTS 349,890 A * 9/1886 Laxton ..... A47K 5/02 312/351
D193,970 S * 11/1962 Forsman ..... D6/536
3,910,661 A 10/1975 Geary
D247,999 S * 5/1978 Whatley ..... D6/536
4,277,042 A * 7/1981 Ash, Sr. ..... A47K 5/05 248/205.3
D261,081 S * 10/1981 Nagel ..... D6/536
4,527,764 A * 7/1985 Krause ..... A47K 5/08 206/77.1
D311,656 S * 10/1990 Yeh ..... D6/536
4,993,546 A * 2/1991 Southard ..... A47K 1/08 206/77.1
5,180,067 A * 1/1993 Conaway ..... A47K 3/281 211/119
5,181,606 A * 1/1993 Martell ..... A47K 5/03 206/77.1
5,253,752 A 10/1993 Jang
5,425,149 A * 6/1995 Crossley ..... A47K 3/064 4/572.1
D362,986 S * 10/1995 Kuan ..... D6/536
5,680,929 A 10/1997 Von Seidel
D385,736 S * 11/1997 Bromley ..... D6/540
D386,026 S * 11/1997 von Buelow ..... D6/540
D386,029 S * 11/1997 Hsu ..... D6/536
D428,737 S * 8/2000 Forshay ..... D6/682.2
D438,740 S * 3/2001 Donnell ..... D6/542
6,223,900 B1 * 5/2001 Pappas ..... A47B 47/00 206/373
6,321,905 B1 * 11/2001 Sykes ..... E05B 73/0023 206/1.5
D532,230 S * 11/2006 Snell ..... D6/525
(Continued)

*Primary Examiner* — Ernesto Grano

(57) ABSTRACT

A sloped soap holder including a rectangular base unit and a plurality of foot members disposed on a bottom surface of the rectangular base unit. A single continuous sloped soap platform is disposed on a top surface of the rectangular base unit. Each of a right pair and a left pair of a plurality of a pair of vertically disposed X-shaped side supports has a lower surface disposed on the top surface of the rectangular base unit and an inner surface attached to each of the right edge and the left edge, respectively, of the sloped soap platform. Each of a plurality of drain openings and a plurality of linear grooves is disposed within the sloped soap platform. A plurality of raised diagonally disposed linear tracks is also disposed on the sloped soap platform.

4 Claims, 5 Drawing Sheets

(56) References Cited

U.S. PATENT DOCUMENTS

| | | | | | |
|---|---|---|---|---|---|
| D534,700 | S * | 1/2007 | Sellers | D32/55 | |
| D637,035 | S * | 5/2011 | Zorovich | D7/387 | |
| D666,041 | S * | 8/2012 | Hwang | D6/536 | |
| D668,496 | S * | 10/2012 | Ho | D6/553 | |
| D713,652 | S * | 9/2014 | Barclay | D6/536 | |
| 8,925,880 | B2 * | 1/2015 | Valembois | B29C 33/485 | 248/200 |
| D723,293 | S * | 3/2015 | Goodman | D6/513 | |
| 9,469,518 | B2 * | 10/2016 | Davis | B67D 1/16 | |
| D785,969 | S * | 5/2017 | Burrow | D6/536 | |
| 2004/0055977 | A1 * | 3/2004 | Ryan | A47K 1/09 | 211/65 |
| 2005/0229302 | A1 * | 10/2005 | Sundberg | A47K 3/034 | 4/572.1 |
| 2006/0202097 | A1 * | 9/2006 | Black | A47K 5/05 | 248/346.01 |
| 2011/0023227 | A1 * | 2/2011 | Sines | A47K 5/03 | 4/628 |
| 2013/0043360 | A1 * | 2/2013 | Pixley | A47K 5/02 | 248/231.91 |
| 2014/0239135 | A1 * | 8/2014 | Barclay | A47K 5/03 | 248/149 |
| 2015/0182077 | A1 * | 7/2015 | Dye | A47K 5/08 | 211/85.12 |
| 2016/0143488 | A1 * | 5/2016 | Hierath | A47K 5/02 | 248/346.11 |
| 2016/0213202 | A1 * | 7/2016 | Akinpade | A47K 5/08 | |
| 2018/0133099 | A1 * | 5/2018 | Wade | A61H 23/02 | |

* cited by examiner

SLOPED SOAP HOLDER

BACKGROUND OF THE INVENTION

Various types of soap holders are known in the prior art. However, what has been needed is a sloped soap holder including a rectangular base unit and a plurality of foot members disposed on a bottom surface of the rectangular base unit. What has been further needed is a single continuous sloped soap platform disposed on a top surface of the rectangular base unit, and each of a right pair and a left pair of a plurality of a pair of vertically disposed X-shaped side supports having a lower surface disposed on the top surface of the rectangular base unit and an inner surface attached to each of the right edge and the left edge, respectively, of the sloped soap platform. Lastly, what has been needed is for each of a plurality of drain openings and a plurality of linear grooves to be disposed within the sloped soap platform, and for a plurality of raised diagonally disposed linear tracks to also be disposed on the sloped soap platform. Unlike other soap holders, the sloped soap holder is thus structured to better drain and preserve a soap bar through the raised sloped soap platform and the plurality of drain openings disposed within the raised sloped soap platform.

FIELD OF THE INVENTION

The present invention relates to soap holders, and more particularly, to a sloped soap holder.

SUMMARY OF THE INVENTION

The general purpose of the present sloped soap holder, described subsequently in greater detail, is to provide a sloped soap holder which has many novel features that result in a sloped soap holder which is not anticipated, rendered obvious, suggested, or even implied by prior art, either alone or in combination thereof.

To accomplish this, the present sloped soap holder includes a rectangular base unit having a front side, a rear side, a right side, a left side, a top surface, and a bottom surface. A plurality of foot members, optionally four, is disposed on the bottom surface of the rectangular base unit. Each of the plurality of foot members is optionally rubberized for improved traction. A single continuous sloped soap platform is disposed on the top surface of the rectangular base unit. The sloped soap platform has a right edge, a left edge, a U-shaped bottom portion disposed proximal the front side of the rectangular base unit, a flattened square top portion, and a sloped middle portion disposed between the U-shaped bottom portion and the flattened square top portion. The sloped middle portion is downwardly sloped from the flattened square top portion to the U-shaped bottom portion.

The sloped soap holder further includes a plurality of a pair of vertically disposed X-shaped side supports including a right pair and a left pair. Each of the right pair and the left pair has a lower surface, an upper surface, an inner surface, and an outer surface. The lower surface of each of the right pair and the left pair is disposed on the top surface of the rectangular base unit and the inner surface proximal the upper surface is attached to each of the right edge and the left edge, respectively, of the sloped soap platform between the flattened square top portion and the sloped middle portion.

A plurality of drain openings is continuously and medially disposed within the sloped middle portion of the sloped soap platform from proximal the flattened square top portion to proximal the U-shaped bottom portion. A plurality of linear grooves is disposed within the U-shaped bottom portion of the sloped soap platform. Each of the plurality of linear grooves is disposed from proximal the right edge of the sloped soap platform to proximal the left edge of the sloped soap platform. A plurality of raised diagonally disposed linear tracks is also disposed on a top area of the sloped middle portion of the sloped soap platform. A soap bar is removably disposed atop each of the U-shaped bottom portion and the sloped middle portion of the sloped soap platform.

The sloped soap platform, in combination with the plurality of linear grooves, the plurality of raised diagonally disposed linear tracks, and the plurality of drain openings, is specifically structured to better drain, grasp, and preserve a soap bar within a soap holder. Each of the plurality of drain openings and the plurality of raised diagonally disposed linear tracks is optionally five in order to ensure proper drainage and a sufficient gripping surface for the soap bar.

Thus has been broadly outlined the more important features of the present sloped soap holder so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
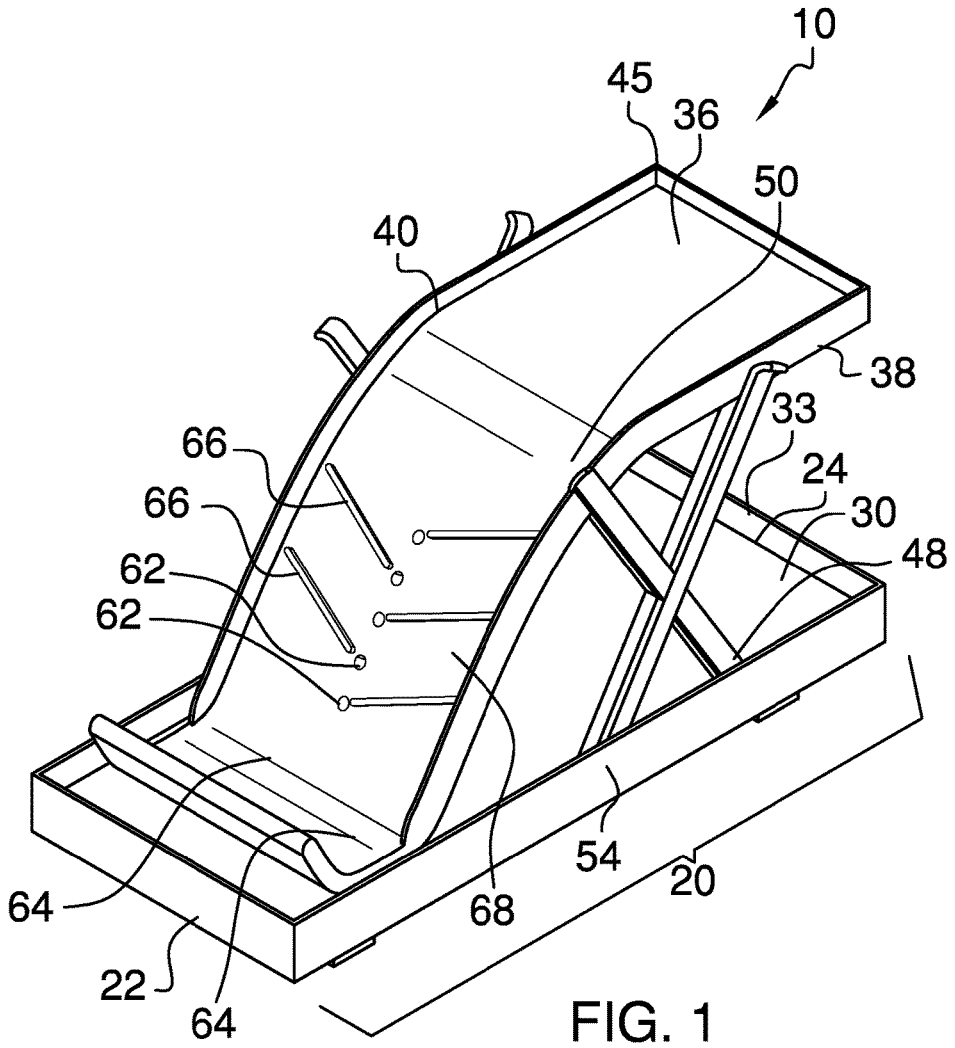
FIG. 1 is a front isometric view.
Figure 2:
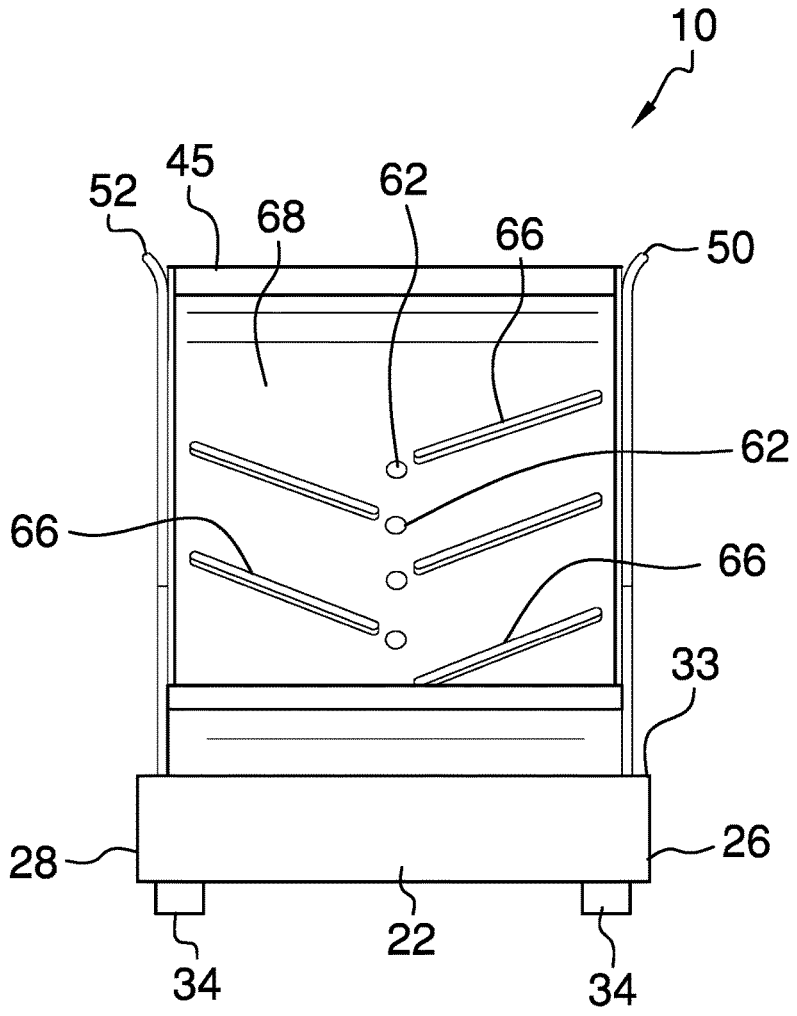
FIG. 2 is a front elevation view.
Figure 3:
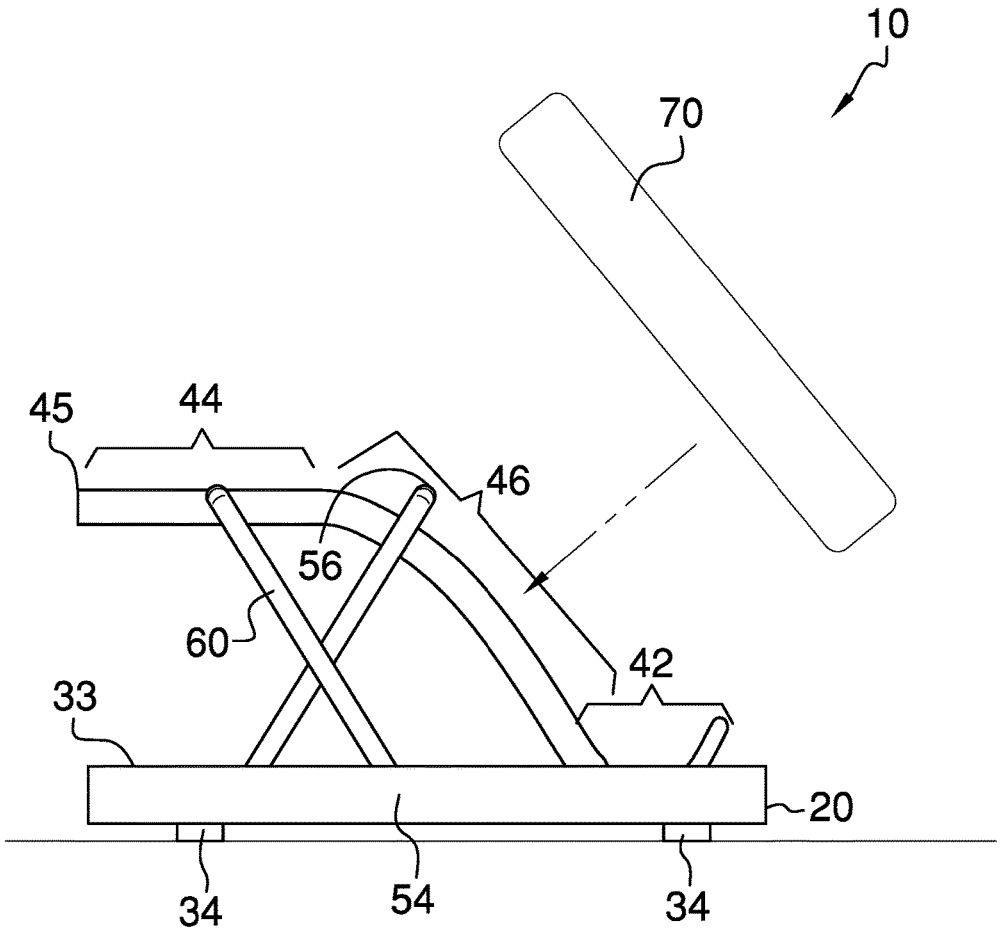
FIG. 3 is a side elevation view.
Figure 4:
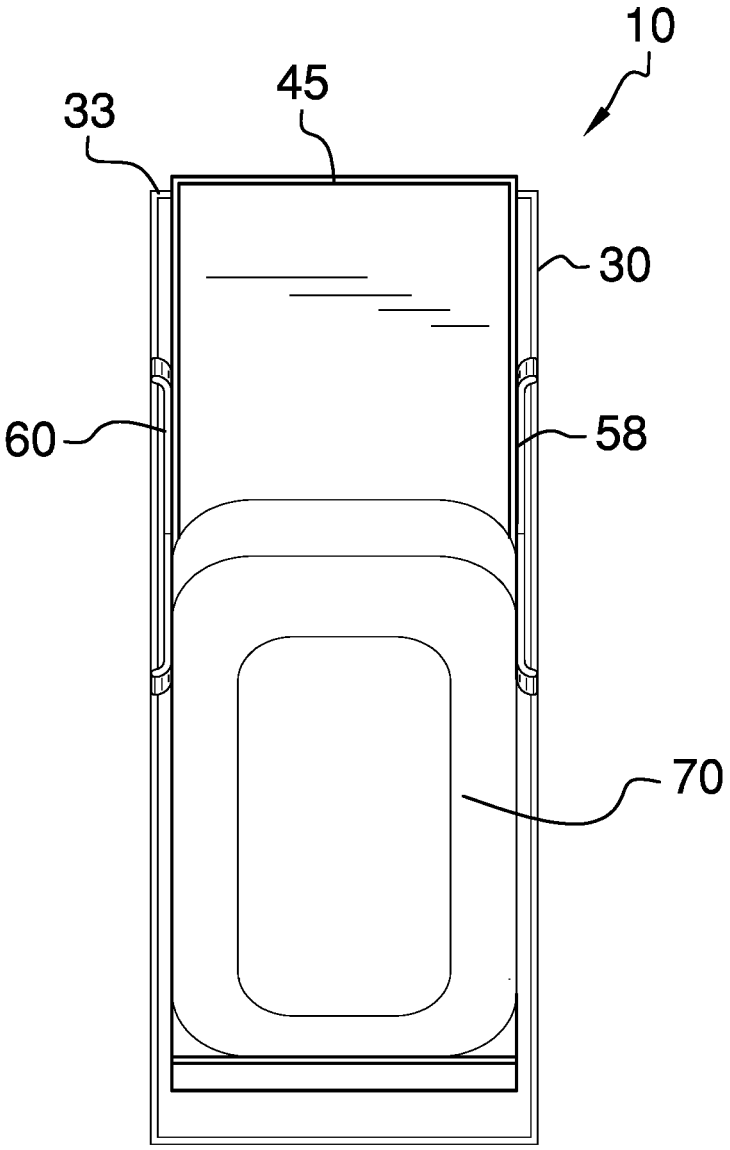
FIG. 4 is a top plan view.
Figure 5:
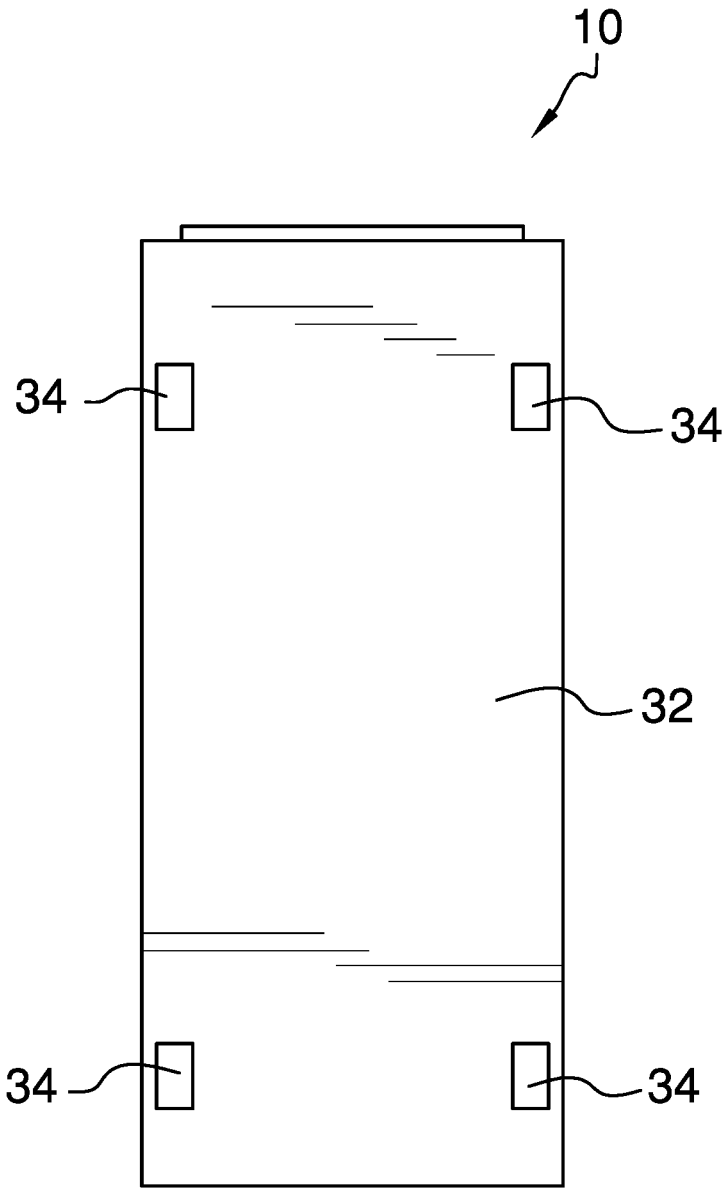
FIG. 5 is a bottom plan view.

With reference now to the drawings, and in particular FIGS. 1 through 5 thereof, an example of the instant sloped soap holder employing the principles and concepts of the present sloped soap holder and generally designated by the reference number 10 will be described.

Referring to FIGS. 1 through 5 the present sloped soap holder 10 is illustrated. The sloped soap holder 10 includes a rectangular base unit 20 having a front side 22, a rear side 24, a right side 26, a left side 28, a top surface 30, and a bottom surface 32. A plurality of foot members 34, optionally four, is disposed on the bottom surface 32 of the rectangular base unit 20. A single continuous sloped soap platform 36 is disposed on the top surface 30 of the rectangular base unit 20. The sloped soap platform 36 has a right edge 38, a left edge 40, a U-shaped bottom portion 42 disposed proximal the front side 22 of the rectangular base unit 20, a flattened square top portion 44, and a sloped middle portion 46 disposed between the U-shaped bottom portion 42 and the flattened square top portion 44. The sloped middle portion 46 is downwardly sloped from the flattened square top portion 44 to the U-shaped bottom portion 42.

The sloped soap holder 10 further includes a plurality of a pair of vertically disposed X-shaped side supports 48 including a right pair 50 and a left pair 52. Each of the right pair 50 and the left pair 52 has a lower surface 54, an upper surface 56, an inner surface 58, and an outer surface 60. The lower surface 54 of each of the right pair 50 and the left pair 52 is disposed on the top surface 30 of the rectangular base unit 20 and the inner surface 58 proximal the upper surface

56 is attached to each of the right edge 38 and the left edge 40, respectively, of the sloped soap platform 36 between the flattened square top portion 44 and the sloped middle portion 46.

A plurality of drain openings 62 is continuously and medially disposed within the sloped middle portion 46 of the sloped soap platform 36 from proximal the flattened square top portion 44 to proximal the U-shaped bottom portion 42. A plurality of linear grooves 64 is disposed within the U-shaped bottom portion 42 of the sloped soap platform 36. Each of the plurality of linear grooves 64 is disposed from proximal the right edge 38 of the sloped soap platform 36 to proximal the left edge 40 of the sloped soap platform 36. A plurality of raised diagonally disposed linear tracks 66 is also disposed on a top area 68 of the sloped middle portion 46 of the sloped soap platform 36. A soap bar 70 is removably disposed atop each of the U-shaped bottom portion 42 and the sloped middle portion 46 of the sloped soap platform 36. Each of the plurality of drain openings 62 and the plurality of raised diagonally disposed linear tracks 66 is optionally five.

What is claimed is:

1. A sloped soap holder comprising:

a rectangular base unit having a front side, a rear side, a right side, a left side, a top surface, and a bottom surface;

a plurality of foot members disposed on the bottom surface of the rectangular base unit;

a single continuous sloped soap platform disposed on the top surface of the rectangular base unit, the sloped soap platform having a right edge, a left edge, a U-shaped bottom portion disposed proximal the front side of the rectangular base unit, a flattened square top portion, and a sloped middle portion disposed between the U-shaped bottom portion and the flattened square top portion, wherein the sloped middle portion is downwardly sloped from the flattened square top portion to the U-shaped bottom portion;

a plurality of a pair of vertically disposed X-shaped side supports comprising a right pair and a left pair, each of the right pair and the left pair having a lower surface, an upper surface, an inner surface, and an outer surface, wherein the lower surface of each of the right pair and the left pair is disposed on the top surface of the rectangular base unit and the inner surface proximal the upper surface is attached to each of the right edge and the left edge, respectively, of the sloped soap platform between the flattened square top portion and the sloped middle portion;

a plurality of drain openings continuously and medially disposed within the sloped middle portion of the sloped soap platform from proximal the flattened square top portion to proximal the U-shaped bottom portion;

a plurality of linear grooves disposed within the U-shaped bottom portion of the sloped soap platform, wherein each of the plurality of linear grooves is disposed from proximal the right edge of the sloped soap platform to proximal the left edge of the sloped soap platform; and a plurality of raised diagonally disposed linear tracks disposed on a top area of the sloped middle portion of the sloped soap platform;

wherein a soap bar is removably disposed atop each of the U-shaped bottom portion and the sloped middle portion of the sloped soap platform.

2. The sloped soap holder of claim 1 wherein each of the plurality of foot members is four.

3. The sloped soap holder of claim 2 wherein the plurality of drain openings is five.

4. The sloped soap holder of claim 3 wherein the plurality of raised diagonally disposed linear tracks is five.

* * * * *